United States Patent [19]

Schaffer et al.

[11] 3,956,878

[45] May 18, 1976

[54] HIGH SPEED TEXTURING

[75] Inventors: Peter Schaffer; Geoffrey R. Scantlebury, both of Charlotte, N.C.

[73] Assignee: Fiber Industries, Inc., Charlotte, N.C.

[22] Filed: Sept. 10, 1974

[21] Appl. No.: 504,481

[52] U.S. Cl. ..... 57/157 TS

[51] Int. Cl.[2] ..... D02G 1/02; D01H 7/92; D01H 13/28

[58] Field of Search ..... 57/34 HS, 157 TS

[56] References Cited

UNITED STATES PATENTS

| | | | |
|---|---|---|---|
| 3,535,866 | 10/1970 | Tsuruta et al. | 57/157 TS X |
| 3,695,026 | 10/1972 | Taylor | 57/157 TS X |
| 3,706,192 | 12/1972 | Leibbrand et al. | 57/34 HS |
| 3,772,872 | 11/1973 | Piazza et al. | 57/157 TS X |
| 3,780,515 | 12/1973 | Waters | 57/157 TS X |
| 3,796,036 | 3/1974 | Parker | 57/157 TS |
| 3,816,994 | 6/1974 | Small | 57/157 TS |
| 3,877,213 | 3/1975 | McFarlane | 57/157 TS |

*Primary Examiner*—Donald E. Watkins
*Attorney, Agent, or Firm*—Herbert M. Adrian, Jr.

[57] ABSTRACT

A process is described for false twist texturing polyester filament yarn at greatly enhanced speeds while inserting comparable twist levels and obtaining comparable yarn bulk without increasing yarn heat setting lengths. The process is particularly adopted to the utilization of partially oriented yarns in a draw texturing operation utilizing friction twisting as the means for simultaneously drawing and heat setting the yarn in a twisted state.

14 Claims, 4 Drawing Figures

HIGH SPEED TEXTURING

BACKGROUND OF THE INVENTION

This invention relates to a method for increasing the texturing speeds of false-twist, draw-texturing processes such that the throughput of yarn can be enhanced by a factor of two or more times that previously obtainable by conventional draw-twisting texturing means. More particularly, the invention is directed to the production of false twist textured polyester continuous filament yarn at substantially increased throughput speeds without sacrifice of yarn properties, particularly yarn twist levels and bulk, and without the requirement of increased heat setting lengths.

In recent years, it has been recognized that false-twist texturing processes can be substantially improved both economically and in quality by combining the steps of drawing which were previously conventionally done by fiber manufacturers and the steps of twisting and heat setting the yarn in the twisted state. This latter step, known as texturing, was conventionally done by persons other than the fiber producer, i.e. throwsters. In combining the two steps, it has been found that not only has the previous separate drawing step been eliminated, but also improvements in textured yarn uniformity are realized.

Draw-texturing, however, has certain mechanical factors which physically limit the speed at which the yarn can pass through the texturing machinery. Practically all of the commercially operated false-twist texturing processes utilize what is known as spindle twisting to insert twist into the yarn which twist is heat set to produce the textured yarn. The twisting spindles must rotate once for every twist that is placed into the yarn and, thus, when the yarn is twisted at the relatively conventional rate of say 60 twists per inch, the spindle must rotate 60 times for every inch the yarn is forwarded through the apparatus. Thus, as a practical matter, the yarn forwarding speed through the apparatus is limited to approximately 650 to 675 feet per minute. Such a forwarding speed requires a spindle rotation at a speed approaching 500,000 revolutions per minute. At such speeds, the spindle has reached a speed wherein it becomes unstable and cannot be retained in the driven position with known spindle apparatuses. Additionally, there may well be a physical limit to the spindle speed based on the mass of the spindle which will limit the rotational speed to about that which can be achieved with present apparatuses.

A further factor in speed limitation is the heater length whereby the yarn is heat set in the twisted state. As the speed of the yarn increases, the residence time in a given length of heater means decreases. For a given yarn and temperature, however, the time required to bring the yarn to the heat setting temperature and set it does not change. In doubling the yarn throughput speed, it would be expected that the heater length zone would have to be at least lengthened, if not doubled. This, in fact, has been found to be the case with drawn and undrawn yarn. The consequent failure to increase the heater length zone results in a marked decrease in the bulk of the yarn so processed.

It is an object of the present invention to provide a method for overcoming the previous physical limitations in false twist texturing processing such that yarns can be processed at higher throughput speeds without increasing heater length and without reduction in the bulk of the yarn.

It is another object of the present invention to provide a process for false twist texturing yarns at speeds in excess of 850 feet per minute at twist levels of 54 or more twists per inch to produce yarns of comparable bulk and uniformity as previous methods.

It is a further object of the present invention to provide a process for producing higher bulk at comparable twist levels in polyester yarns.

These and other objects of the invention will become apparent from the description of the invention which follows.

SUMMARY OF THE INVENTION

In accordance with the invention, there is provided a process for producing a false-twist crimped polyester multifilament yarn wherein the polyester yarn to be textured is fed into a simultaneous drawing and false-twist crimping zone consisting of a heater and false twister positioned between the feed means and draw roll means and wherein the inserted twist backs upstream into the heated zone wherein the twist is heat set in the yarn and the yarn is drawn in the heated zone, the improvement comprising feeding said yarn at a speed as measured at the draw roll means of more than 850 feet per minute, said feed yarn being partially oriented, having a birefringence of at least 0.020, a crystallinity of not more than 40 percent and a break elongation of 50 to 200 percent, twisting said yarn 40 to 200 twists per inch, heating and drawing the twisted yarn 1.1 to 2.5 times the fed length at a temperature of at least 180° centigrade to just below the melting point of said yarn and untwisting said yarn prior to take-up.

The process of the present invention is best realized by utilizing friction twisting means rather than spindle twisting means. Using the present invention, textured polyester yarns generally have higher tenacity, higher tensile factor and greater skein shrinkage (developed bulk) than prior processes using conventionally drawn or undrawn feed yarns and/or higher developed bulk at higher texturing speeds with equivalent heat setting lengths. Previous processes using conventional drawn of undrawn feed yarn fail to produce commercially acceptable developed bulk at texturing speeds in excess of about 800–850 feet per minute whereas the present process provides texturing speeds of 4000 or more feet per minute.

DETAILS OF THE INVENTION

The invention will be more fully described by reference to the accompanying drawings in which.

As has been noted above, there are several factors which have limited the texturing speeds which could be obtained in false twist crimping processes. The physical capacity of conventional spindle equipment is but one limitation to such speeds. This limitation can be overcome by the utilization of friction twisting means such as rotating flanges, discs, cylinders and the like which are well known in the art. However, in operating at such high speeds, the ability of the yarn to absorb heat and to be cooled as is necessary in the heat setting of twist in the yarn becomes another limiting factor. The present invention overcomes the limiting factor of heat input into the yarn utilizing conventional heat setting equipment and conventional heater lengths. The yarn, however, must be cooled in the time interval between heat setting of the twist and the untwisting of the yarn. Unless some cooling means are provided for the freshly drawn (false twisted, heated) yarn, the time lapse between the yarn coming off of the heating means and being untwisted by passing through the twisting device is too short in commercially practical machinery. Without adequately cooling the yarn prior to untwisting, the twist is untwisted from the yarn while it is still hot, thereby partially erasing the effect of heat setting in the highly twisted state.

Therefore, in accordance with the present invention, the yarn coming from the draw-false twisting heat zone is cooled, either by the application of cooling gases such as air jets, air guides or other means, or by the maintaining of an adequate time interval for the yarn to cool prior to being untwisted. With increasing speeds, increased distances between the twisting means and the draw-false twist heater zone is one means for insuring such cooling. Other means such as cooling plates, threadline vibratory devices and the like can be used to ensure adequate cooling.

Figure 1:
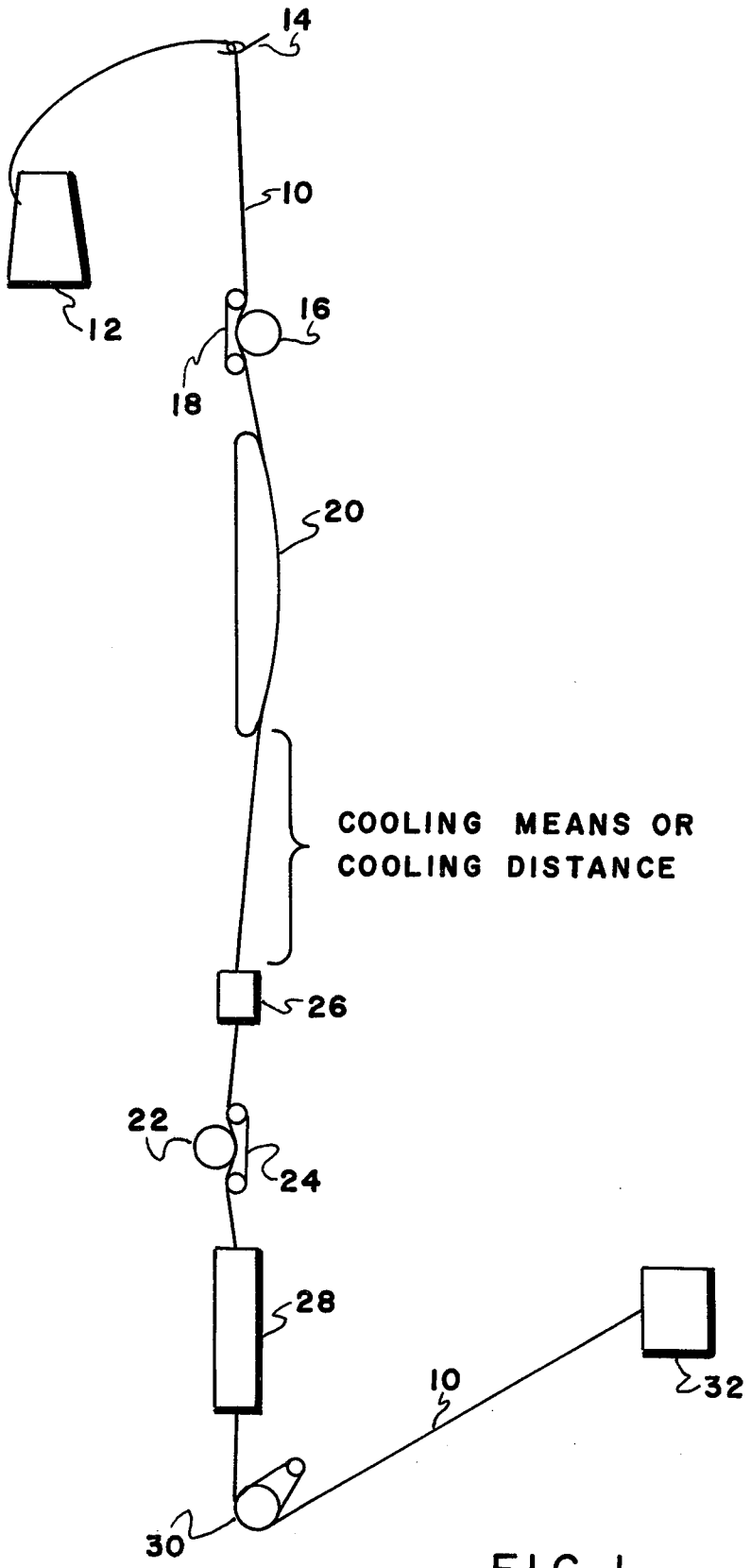
FIG. 1 is a partial schematic representation of a method for operating the present invention.

Referring more particularly to FIG. 1, a preferred embodiment of the present invention is illustrated wherein flat yarn 10 is is withdrawn from a yarn supply 12 across yarn guides 14 to feed roll 16 in contact with nip means 18. Yarn from feed roll 16 passes in contact with heater zone 20, which is preferably a heated plate. A drawing tension is applied by means of draw roll 22 in contact with nip means 24. This drawing tension is passed through twisting means 26 and back along the yarn to heater zone 20 wherein it is dissipated in drawing of the yarn which takes place on the heater plate or within the heater zone.

Twisting means 26 inserts twist into the yarn which again backs up the yarn into heater zone 20 wherein it is heat set in the twisted configuration during drawing of the yarn in the heater zone. Contrary to previous draw-texturing feeder yarns, the present yarn and method does not result in a precise necking down point in the yarn to define a specific draw point but rather the draw is accomplished over an area of length within the heater zone.

Heater zone 20, as noted above, is preferably a heated plate but could be a hot pin, heated rolls, steam chamber, hot air oven or the like heating means which are capable of heating the yarn above the second order transition temperature and preferably to the desired heat setting temperature of the yarn of 180° to 250° centigrade. The critical temperature in the process is the temperature of the yarn which temperature is referred to herein. The heating zone per se can and often is at a temperature greatly in excess of the temperature which the yarn actually attains. Such heater temperatures can be well in excess of the yarn melting temperature, with the speed of the yarn being sufficiently high to prevent melting of the yarn.

Twisting means 26 can be any of the numerous known twisting devices which are capable of inserting the desired degree of twist into the yarn at the high linear speed at which the present invention is utilized. Such twisting devices are capable of putting at least 40, and more preferably 50, twists per inch (t.p.i.) and up to as much as 200 t.p.i. depending on the yarn denier into the yarn at a yarn linear rate of speed of 850 to 4000 feet per minute or more but most preferably in the range of 1000 to 4000 feet per minute. While spindle twisters are presently incapable of operating in these speeds, it is expected that improvements will be made such that spindles will eventually be operable at higher speeds than presently. When such higher speed spindles are available, they could be utilized with the present invention. However, present technology generally makes it desirable to utilize friction twisters which can place the required number of twists into the yarn at the noted linear speeds.

The amount of twist put into the yarn is dependant on the yarn denier and the desired amount of bulk, Thus, for low denier and monofilament yarn, higher twist levels are normally used while for higher deniers, lower twist levels are required for desirable bulk. The most desirable twist level ranges for various yarns can be expressed by the equation:

$$\frac{480}{\sqrt{\text{denier}}} \text{ to } \frac{1000}{\sqrt{\text{denier}}} = TPI$$

Yarn passing out of twisting means 26 is untwisted as it travels to draw roll 22 and nip roll 24. Second heater 28 is employed to develop bulk in the yarn, particularly when polyester yarns are being false twist textured for eventual application in circular knit and warp knits. Certain other yarns and end uses do not necessarily require a second heater. In passing through the second heater, the yarn is preferably relaxed 5 to 30 percent between draw roll 22 and nip roll 24 and take-up roll 30. The exact amount of relaxation of the yarn in second heater 28 is dependent upon several factors including inserted twist, desired bulk development, subsequent residual shrinkage of the yarn, fiber denier, total yarn denier and the like factors. Second heater 28 is operated at a temperature preferably lower than heater zone 20 such as to provide a yarn temperature in the range of about 180° to 230° centigrade.

From take-up roll 30, the yarn is packaged onto bobbins or packages 32.

The feeder yarn of the present invention is produced by the high speed take-up of polyester yarn to thereby develop a birefringence in the yarn of at least 0.020 up to less than fully drawn or about 0.100. At such high speed take-up, the yarn develops less crystallinity than conventionally drawn yarns such that the crystallinity is normally less than 40 percent and most usually 10 to 30 percent, although the crystallinity can be as low as 0 percent. The yarn, however, does have residual elongation such that further drawing can be effected to reduce the break elongation from an original 50 to 200 percent to a break elongation after draw-texturing of about 20 or less percent.

Birefringence is measured by the retardation technique described in "Fibres from Synthetic Polymers" by R. Hill (Elsevier Publishing Company, New York, 1953), pages 266–8, using a polarizing microscope with rotatable stage together with a Berek compensator or cap analyzer and quartz wedge. The birefringence is calculated by dividing the measured retardation by the measured thickness of the fiber, expressed in the same units as the retardation. For samples in which the retardation technique is difficult to apply because of non-round fiber cross section, presence of dye in the fiber, etc., an alternative birefringence determination such as the Becke line method described by Hill may be employed.

Crystallinity may be measured by simple density measurements, for example, by the method described in "Physical Methods of Investigating Textiles", R. Meridith and J. W. S. Hearle, Textile Book Publishers, Inc., 1959 at pages 174–176. Carbon tetrachloride and n-heptane are suitable liquids for use with polyethylene terephthalate. The percent crystallinity is derived from the density measurements by linear interpolation between the density of a fully amorphous sample (1.335 gm./cc.) and the density of the crystalline phase (1.455 gm./cc.). For copolymers or fibers containing additives such as $TiO_2$ appropriate adjustment can be made such as are known in the art. The crystallinity of the present feed yarns is often lower than 30 percent.

Considerable knowledge in the high speed spinning of such yarns is known to those skilled in the art. It is generally considered that there is a spinning and take-up speed for polyester yarns above which the yarn is taken up in a fully drawn state. The particular spinning speed needed to accomplish this varies with the particular polyester polymer, the spinning temperature, the cooling rate of the spun fibers, the filament denier, the polymer inherent viscosity and the like factors. It is also apparent that the spinning conditions noted can be correlated to provide less than fully drawn polyethylene terephthalate yarn at speeds in excess of the fastest known spinning equipment. Because the present process depends on at least partially further drawing of the yarn during texturing to thereby take advantage of the desirable results obtained in simultaneously drawing and twisting, the spinning conditions and take-up speeds are selected so as to have the specified crystallinity, birefringence and residual draw ratio. The most desirable feeder yarns used in the present invention are obtained by high speed spinning with a take-up speed of 8.,000 to 15,000 feet per minute, thereby resulting in a residual break elongation of 50 to 200 percent and a birefringence of at least 0.020.

The melt spinnable polyesters utilized in the present process preferably have an intrinsic viscosity (I.V.), in the range of about 0.45 to 1.0 and more preferably in the range of about 0.55 to 0.80. The I.V. is determined by the equation $$\lim_{C \to O} \frac{\ln nr}{C}$$

where $Nr$ is the "relative viscosity". Relative viscosity is determined by dividing the viscosity of an 8 percent solution of polymer in orthocholorophenol solvent by the viscosity of the solvent as measured at 25° centigrade. The polymer concentration in the noted formula is expressed as "C" in grams per 100 milliliters.

The fiber-forming polyester spun commonly exhibits a glass transition temperature of about 75 to 80° centigrade and a melting point of about 250° to 265° centigrade.

The present feed yarn can be prepared from polyester having an intrinsic viscosity of at least 0.45 and preferably 0.60 by melt-spinning at unusually high speeds under conditions which provide an as-spun break elongation of 50 to 200 percent, low crystallinity, and a birefringence of at least 0.020. In the spinning process, high speed yarn take-up means are located below the spinneret at a distance sufficient to permit solidification of the yarn prior to the yarn passing to a high-speed yarn take-up. A spin finish is preferably applied prior to take-up and, if desired, the yarn can be compacted or interlaced prior to take-up.

The filaments are quenched with ambient cooling air as they leave the spinneret. The volume of cooling air use depends upon the cooling means, the spinning speed and the denier, but is readily determined empirically. The quench cooling rate and spinning speed are adjusted to provide the desired break elongation in the feed yarn.

The produced polyester feed yarn is not fully molecularly oriented and not fully crystallized. The polyester to which the present process is directed consists essentially of synthetic linear polyethylene terephthalate ploymer which may contain various modifiers such as materials conventionally used in polyester yarns including chemical and physical modifiers which affect the chemical and physical properties of the fiber. Copolymers of polyethylene terephthalate such as cationic dyeable polyethylene terephthalate with other reactive modifies such as isophthalic acid, sulfo-isophthalic acid, propylene glycol, butylene glycol, and the like co-polymerizable monomers can be used. Yarn meeting the specified requirements of the present process may additionally or alternatively contain minor amounts of materials used in conventional yarns such as dye site modifiers, delusterants, polymer modifiers and the like up to 20 percent but most preferably not more than about 5 percent by weight.

The spun denier of the feeder yarns can vary depending on the end use to which the filament yarn is to be put and the residual draw ratio. Feeder yarn deniers in the range of 15 to 1000 total denier and denier per filaments of 1 to about 10 are preferred.

The invention will be more specifically described by reference to the following examples which describe certain preferred embodiments and are not intended as limiting the invention.

EXAMPLE I (*a*) THROUGH I (*e*)

Continuous filament polyethylene terephtlalate yarn was spun from 0.67 I.V. polymer into 36 filament 300 spun denier yarn having a birefringence of 0.028 and a spun elongation of 180 percent. The yarn was produced at a spinning speed of 8500 feet per minute as measured at take-up. The percent crystallinity was 19 percent. The standard draw ratio to produce flat yarn from this spun partially oriented yarn was about 2.0.

The spun yarn was then draw-textured utilizing a process and yarn string-up as shown in FIG. 1 wherein the feed yarn was passed over a feedroll at a speed of 360 feet per minute and then across a one meter heater plate operated at a temperature of 240° centigrade, through a cooling region, into a friction false twist apparatus and then around a drawroll operated at a speed of 667 feet per minute to effect a draw ratio of 1.88.

Several yarns were textured at different twist inputs range from 56 twists per inch (t.p.i.) to 62 t.p.i. The skein shrinkage on the resulting yarns was then measured to determine the bulk characteristics.

Skein shrinkage properties were determined by winding yarn into skeins of 12,000 total denier on a reel using a winding tension of 8 to 10 grams. The number of yarn wraps on the reel is in accordance with the equation:

$$\text{yarn denier } D = \frac{6000}{\text{number of wraps } (R)}.$$

The yarn is then removed from the reel in a loop configuration with each side of the loop equalling 6000 denier, thereby providing a skein of 12,000 denier. A 20 gram weight is hung on the skein, the length of the skein measured and the weighted skein suspended in water at 82.2° centigrade + 2.8° centigrade for 12 minutes. The skein is removed from the water, lagged for 10 minutes to dry and then the length of the skein is remeasured with a suspended 20 gram weight attached. The skein shrinkage is then calculated according to the formula:

$$\frac{Lo - Lf}{Lo} \times 100 = \%\ \text{Skein Shrinkage}$$

wherein Lo equals the original length of the skein and Lf equals the final length of the skein.

The skein shrinkage test described includes both the effects of bulk or crimp development and linear shrinkage. The yarn linear shrinkage can be determined by a test well known in the art. With the present yarns, linear shrinkage comprises about 10 to 12 percent of the skein shrinkage.

Using the spun yarn of (a) above, several yarns were textured at different twist inputs ranging from 56 t.p.i. to 65 t.p.i. at a texturing take-up speed of 1000 feet per minute and the same draw ratio. The skein shrinkage of the produced yarns was then measured to determine the bulk characteristics.

Again using the partially oriented yarn spun in (a) above, several yarns were textured at different twist inputs ranging from 56 t.p.i. to 65 t.p.i. using Barmag spindle twisting machines at a take-up speed of 667 feet per minute which represents the approximate upper speed limit of spindle twisters. The skein shrinkages of the produced yarns was then measured to determine the bulk characteristics.

Continuous filament 36 filament polyethylene terephtlalate yarn was spun from 0.67 I.V. polymer at a spinning temperature of 285° centigrade and taken up at standard textile spinning speeds of 4650 feet per minute. The spun denier was 410. The birefringence was 0.010.

The produced yarn was then draw-textured using Barmag draw-texturing machines equipped with spindle twisters. The yarn was processed at 667 feet per minute take-up speed and a draw ratio of 2.70. A standard false twisting processing string-up was used. Several yarns were textured with different twist inputs ranging from 56 t.p.i. to 65 t.p.i. The skein shrinkages of the produced yarns was then measured to determine the bulk characteristics.

The yarn spun in (d) above was drawn to 160/36 yarn to produce standard flat fully drawn texturing yarn. This yarn was then spindle textured in the manner conventionally done by throwsters. The yarn was processed at a take-up speed of 667 feet per minute with various yarns being textured at twist inputs ranging from 60 to 65 t.p.i. The skein shrinkage of the produced yarns was then measured to determine the bulk characteristics.

All of the yarns in the above examples were textured using one meter hot plates set at 240° centigrade and drawn to 160/36 yarns.

Figure 2:
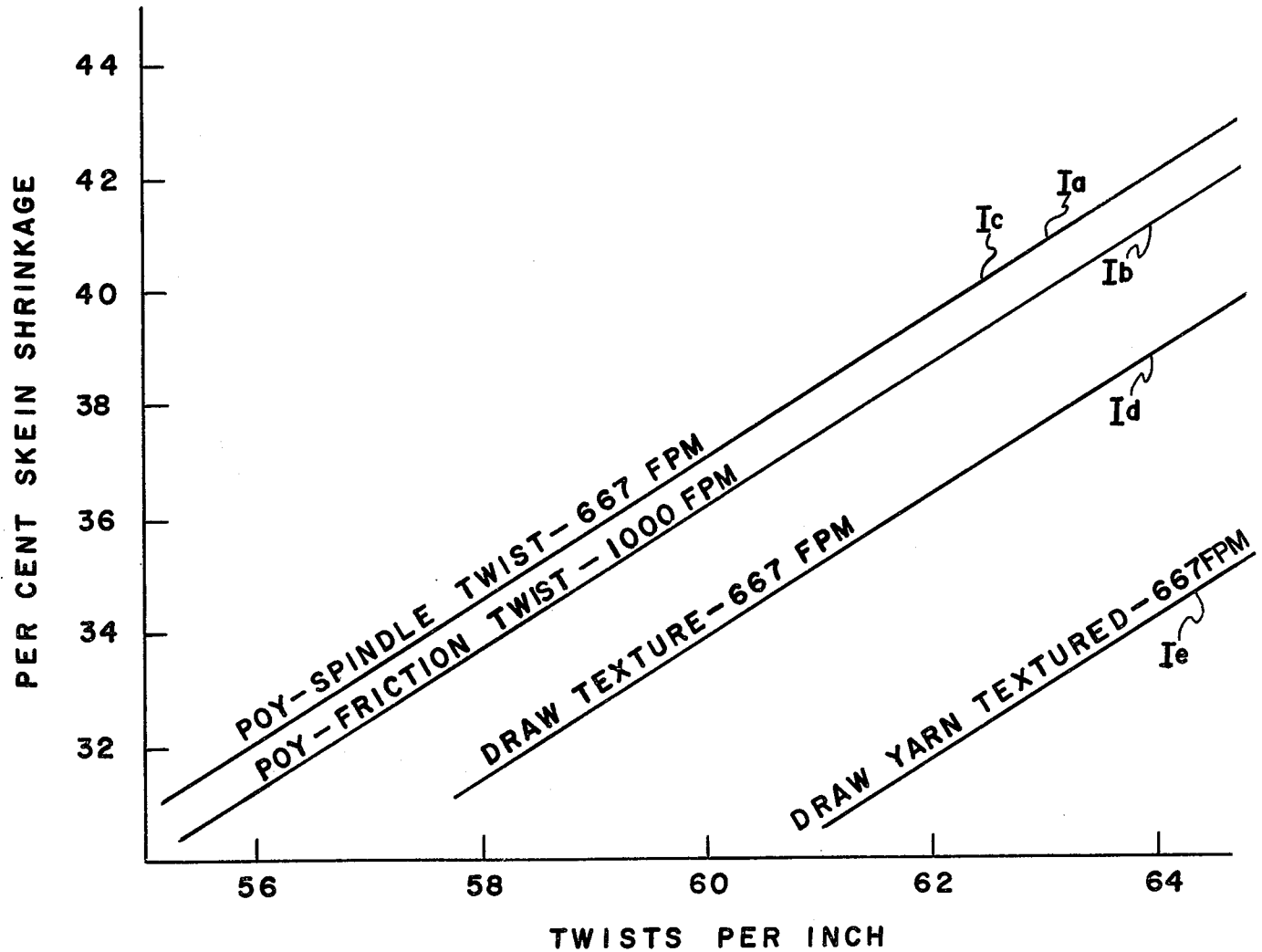
FIG. 2 is a graph which illustrates the bulk development of yarns of the present invention compared to the prior art.

FIG. 2 plots the skein shrinkage of the yarns of the above examples wherein the plot is designated by example paragraph letter. The graph illustrates that for a given twist input, partially oriented yarns (POY) develop higher bulk than either fully drawn or draw textured yarns. Consequently, a lower t.p.i. can be utilized to achieve comparable bulk with the partially oriented yarns. Further, as shall be more clearly illustrated in the following examples, texturing speeds can be greatly increased without sacrificing bulk properties when the yarn is textured in accordance with processes set forth herein such as utilizing the described texturing string-up or forced air cooling and adequate heat setting input.

EXAMPLE II (*a*) THROUGH II (*d*)

This example compares the effect of partial orientation of the feeder yarn as developed by increased spinning speeds versus the texturing speed and bulk developed at a variety of texturing speeds. The comparison of the various yarns indicates that increasing spinning speeds to increase spun orientation with crystallinity of 30 percent or less provides a yarn which can be false twist textured at higher texturing speeds to produce comparable bulk using the same heat setting length. By increasing the heat setting length, the texturing speeds can be proportionally increased such that with the fastest spun yarns, i.e. those with the highest orientation and lowest residual draw ratios and elongations, texturing speeds of in excess of 4000 feet per minute are attainable with acceptable bulk using commercially reasonable heater lengths.

Figure 3:
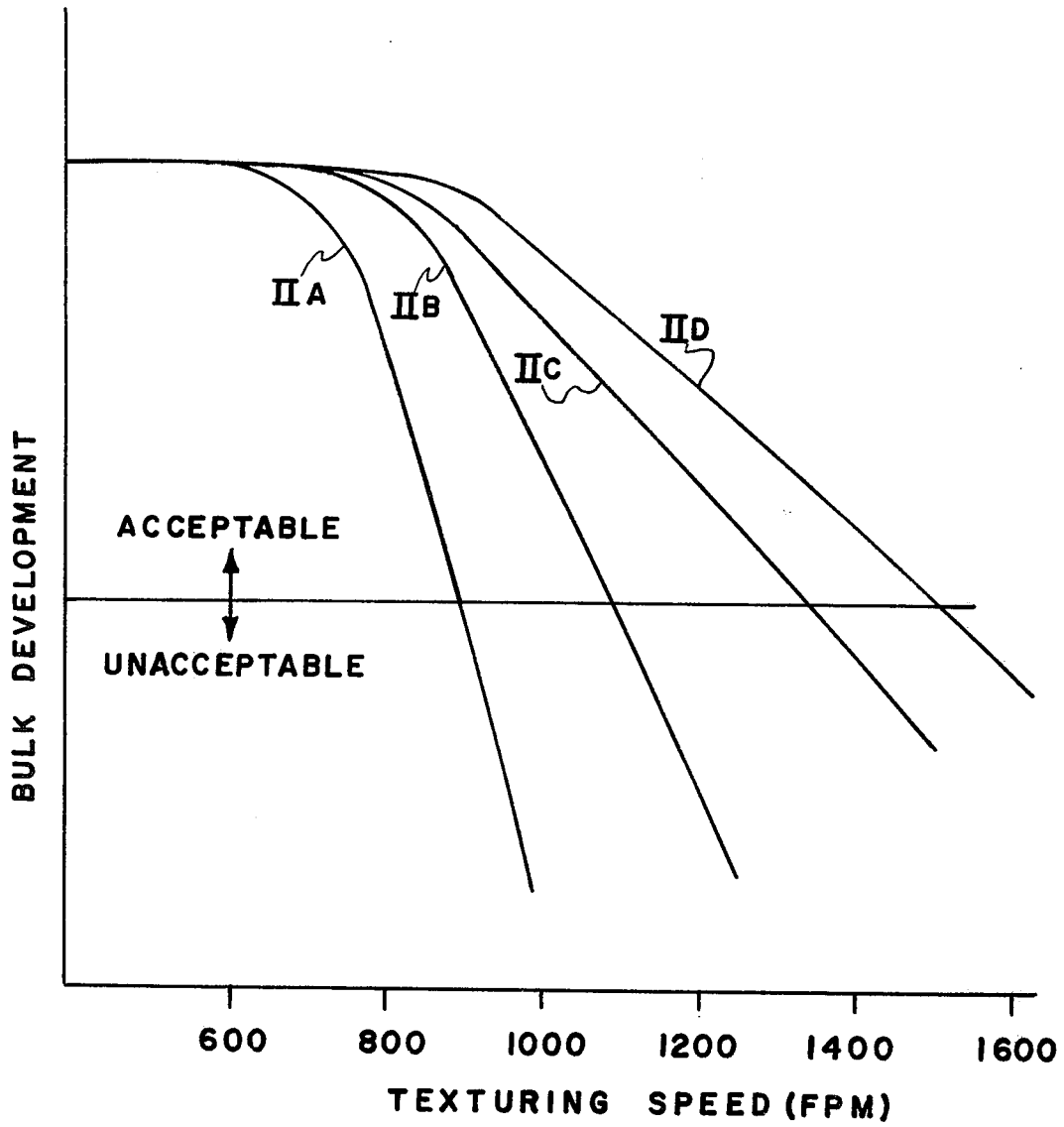
FIG. 3 is a graph which illustrates textured yarn developed bulk versus texturing speed illustrating the improvement of the present invention.

Referring more particularly to FIG. 3, the curves represent the following yarns wherein the letter designation of the curves and paragraphs are the same.

Continuous filament polyethylene terephtlalate yarn was spun from 0.67 I.V. polymer in a standard textile filament melt spinning process to obtain 36 filament yarn. The spinning speed was 4650 feet per minute to produce a spun denier of 410 and a birefringence of 0.010.

The produced yarn was draw textured to 160/36 yarn using friction twisting at various texturing speeds to determine the range of attainable texturing speeds and bulk developed. The yarn was draw-textured at a 2.70 draw ratio, using a one meter heat setting plate set at 240° centigrade and applying a twist input of 60 t.p.i. The skein shrinkage of the textured yarns was then determined and the results plotted against texturing speed on FIG. 3.

Continuous filament polyethylene terephthalate yarn was again spun from 0.67 I.V. polymer wherein the spinning take-up speed was 8500 feet per minute. The resulting feeder yarn was a 36 filament 300 spun denier having a birefringence of 0.028 and a crystallinity of 19 percent. The spun elongation was 185 percent. The standard draw ratio to produce a fully drawn flat yarn was 2.0.

The produced yarn was draw-textured to 160/36 yarn using friction twisting over a range of texturing speeds to determine the bulk developed versus texturing speeds. The twist input was maintained at 60 t.p.i. using a one meter heat setting plate set at 240° centigrade. The skein shrinkage of the textured yarns was then determined and the results plotted against texturing speed on FIG. 3.

Polyethylene terephthalate polymer of 0.67 I.V. was again spun as in (b) above with the exception that the spinning take-up speed was set at 10,000 feet per minute. The resulting yarn had a birefringence of 0.040 and a crystallinity of 23 percent. The spun elongation was 150 percent and the standard draw ratio to produce a fully drawn flat yarn was 1.6.

The produced yarn was draw textured to 160/36 yarn using friction twisting over a range of texturing speeds to determine the bulk developed versus texturing speeds. The twist input was maintained at 60 t.p.i. using a one meter heat setting plate set at 240° centigrade. The skein shrinkage of the textured yarns was then determined and the results plotted against texturing speed on FIG. 3.

Polyethylene terephthalate polymer of 0.67 I.V. was again spun as in (b) above with the exception that the spinning take-up speed was set at 12,000 feet per minute. The resulting yarn had a birefringence of 0.055 and a crystallinity of 30 percent. The spun elongation was 100 percent and the standard draw ratio to produce a fully drawn flat yarn was 1.4.

The produced yarn was draw textured to 160/36 yarn using friction twisting over a range of texturing speeds. The twist input was maintained at 60 t.p.i. using a one meter heat setting plate set at 240° centigrade. The skein shrinkage of the textured yarns was then determined and the results plotted against texturing speed on FIG. 3.

As can be seen from a comparison of the results plotted on FIG. 3, partially oriented yarn as described herein can be textured in accordance with the present invention at much higher speeds than previous yarns and/or higher bulk is developed a comparable twist input.

EXAMPLE III (*a*) THROUGH III (*d*)

This example compares the bulk development of various feeder yarns when textured at different texturing speeds at a constant heat setting temperature regulated to obtain a yarn temperature of 200° centigrade in the draw-twist setting zone. In each of the examples, the heater temperature was set at that temperature which, based on yarn dwell time, provided a yarn temperature in the twist setting zone of 200° centigrade. A heated plate was used with heater temperatures within the range of 243° centigrade to 285 ° centigrade. Texturing speeds range from 800 feet per minute to 4000 feet per minute at a constant twist input of 57 t.p.i.

Continuous filament polyethylene terephthalate yarn was spun from 0.67 I.V. polymer in a standard textile filament melt spinning process to obtain 36 filament yarn. The spinning speed was 4650 feet per minute to produce a spun denier of 410 and a birefringence of 0.010.

The produced yarn was draw textured to 160/36 yarn using a twist input of 57 t.p.i. at a plurality of speeds ranging from 800 feet per minute to 1400 feet per minute operated at a temperature to produce a yarn temperature on the heated plate of 200° centigrade. The skein shrinkage of the textured yarns was then determined and the results plotted against texturing speed on FIG. 4 at III (a).

A continuous filament polyethylene terephthalate yarn was again spun from 0.67 I.V. polymer wherein the spinning take-up speed was 8500 feet per minute. The resulting feeder yarn was 36 filament 300 spun denier having a birefringence of 0.028 and a crystallinity of 19 percent. The spun elongation was 185 percent. The standard draw ratio to produce fully drawn flat yarn was 2.0.

The produced yarn was draw-textured to 160/36 yarn in the same manner as (a) above using a twist input of 57 twists per inch over a range of texturing speeds from 800 feet per minute to 3000 feet per minute. The bulk development of the yarns produced was then determined. The results were plotted against texturing speed on FIG. 3 at III (b).

Polyethylene terephthalate polymer of 0.67 I.V. was again spun as in (b) above with the exception that the spinning take-up speed was set at 10,000 feet per minute. The resulting yarn had a birefringence of 0.040 and a crystallinity of 23 percent. Spun elongation was 150 percent and the standard draw ratio to produce a fully drawn flat yarn was 1.6.

The produced yarn was draw textured to 160/36 yarn in the same manner as (a) above using a twist input of 57 t.p.i. The texturing speeds were varied from 800 feet per minute to 3000 feet per minute and the heat setting temperature was controlled to yield a yarn setting temperature of 200° centigrade. The skein shrinkage of the textured yarns was then determined and the results plotted against texturing speed on FIG. 4 at III (c).

Polyethylene terephthalate polymer of 0.67 I.V. was again spun as in (b) above with the exception that the spinning take-up speed was set at 12,000 feet per minute. The resulting yarn had a birefringence of 0.055 and a crystallinity of 30 percent. The spun elongation was 100 percent and the standard draw ratio to produce a fully drawn flat yarn was 1.4.

The produced yarn was then draw textured to 160/36 yarn in the same manner as (a) above using a 57 t.p.i. input. The heat setting temperature was maintained so as to give a yarn temperature of 200° centigrade in the heat setting zone. The texturing speed was varied from 800 feet per minute to 4000 feet per minute. The skein shrinkage of the textured yarns was then determined and the results plotted against texturing speed on FIG. 4 at III (d).

Figure 4:
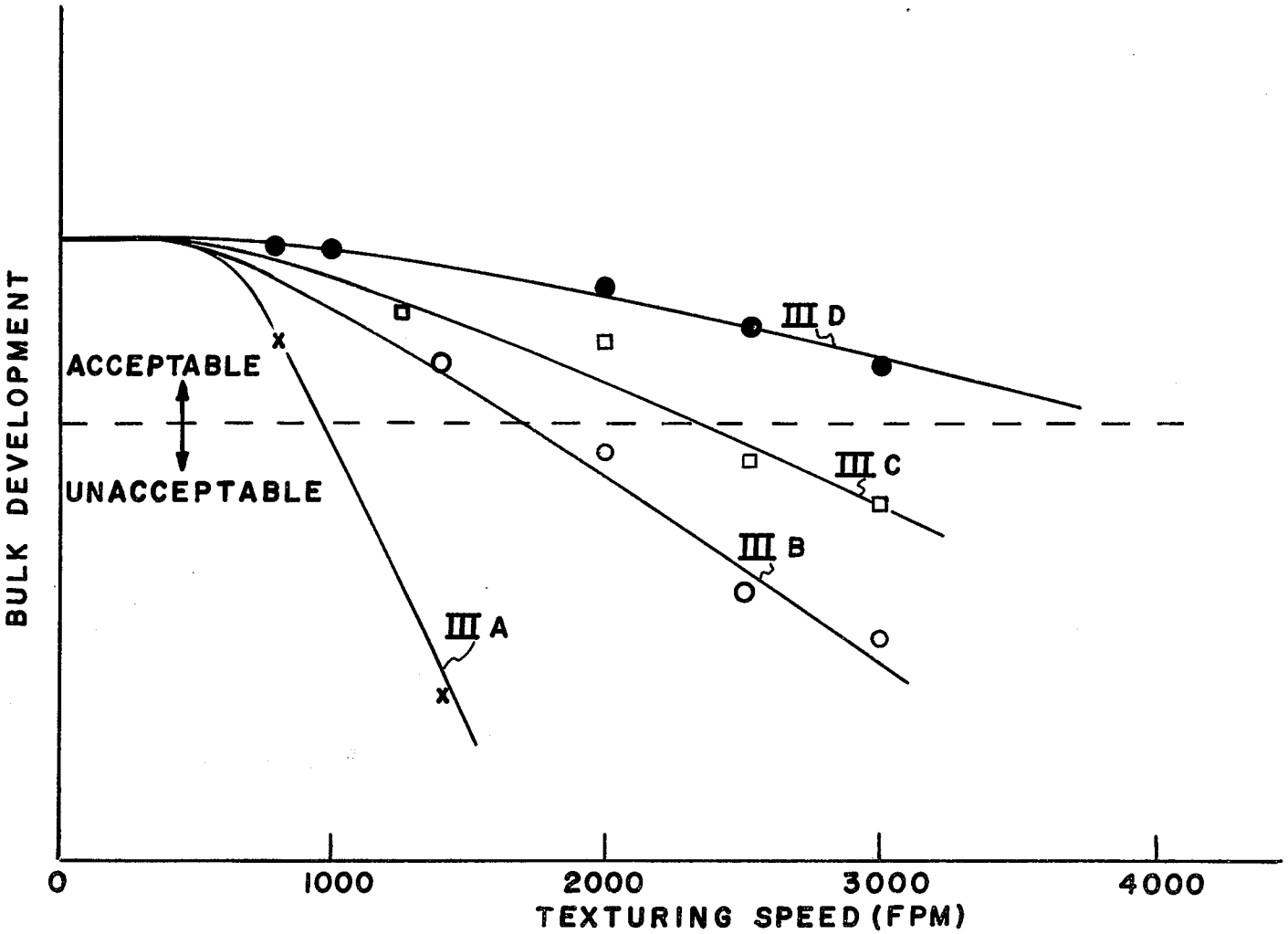
FIG. 4 is another graph which illustrates the textured yarn developed bulk of various feeder yarns at various texturing speeds utilizing constant yarn heat setting temperature.

As can be seen from a comparison of the results plotted on FIG. 4, the partially oriented feeder yarns of the present invention can be textured in accordance with the present invention at much higher speeds than previous yarns and/or higher bulk is developed at comparable twist input. It is clear that feeder yarns produced by previous standard low speed spinning methods inherently are incapable of producing acceptable bulk development at high texturing speeds.

In all of the above examples, the skein shrinkage was measured on yarn prior to a second heater treatment under relaxing tensions. After passing the yarn through a second heater, the skein shrinkage is reduced and the yarn denier increased to 170/36.

While the invention has been described with reference to certain preferred embodiments, it is recognized that various changes therein can be made as are readily apparent to those skilled in the art without departing from the spirit or scope of the invention. Consequently, it is intended that the invention be claimed broadly, being limited only by the apended claims.

What is claimed is:

1. In a process for producing a false twist crimped polyester multifilament yarn wherein a partially oriented polyester yarn is fed into a simultaneous drawing and false twist crimping zone consisting of a heated zone and false twister positioned between feed means and draw roll means and wherein the false twist backs upstream into the heated zone wherein the false twist is set into the yarn and wherein the yarn is drawn in a draw zone within the heated zone, the improvements comprising feeding said yarn at a speed as measured at the draw roll means of more than 850 feet per minute, said feed yarn bei;ng partially oriented, having a birefringence of at least 0.020, a crystallinity of not more than 40 percent and a break elongation of 50 to 200 percent, twisting said yarn 40 to 200 twists per inch, heating and drawing the twisted yarn 1.1 to 2.5 times the fed length at a temperature of at least 180° centigrade to just below the melting point of said yarn and untwisting said yarn prior to take-up.

2. The process of claim 1 wherein the yarn is friction twisted.

3. The process of claim 1 wherein the yarn is textured at a speed in the range of 850 to 4,000 feet per minute.

4. The process of claim 1 wherein the yarn is twisted at a level of $$\frac{480}{\sqrt{\text{denier}}} \text{ to } \frac{1,000}{\sqrt{\text{denier}}}$$

twists per inch.

5. The process of claim 4 wherein the yarn denier is in the range of 15 to 1000 total and 1 to about 10 denier per filament.

6. The process of claim 1 wherein the feed yarn is partially oriented by partially drawing prior to draw-texturing.

7. The process of claim 1 wherein the feed yarn is partially oriented by stress spinning the yarn at a spinning windup speed of 8,000 to 15,000 feet per minute.

8. The process of claim 1 wherein the feeding yarn has a crystallinity of 0 to 40 percent and a birefringence of 0.020 to 0.100.

9. The process of claim 1 wherein the yarn is draw-textured and twist set simultaneously on a heater plate at a yarn temperature of 180° to 240° centigrade.

10. The process of claim 1 wherein the untwisted yarn is heat relaxed prior to take-up in an amount of 1 to 20 percent of the drawn heat set length at a temperature less than the twist set temperature.

11. The process of claim 1 wherein the yarn is cooled between the heater zone and the twister to a temperature below about 120° centigrade.

12. The process of claim 11 wherein the yarn is cooled by increasing the distance between the twist heat setting zone and the false twister in an amount sufficient to effect said cooling.

13. The process of claim 11 wherein the yarn is cooled by forced air cooling.

14. The process of claim 13 wherein the yarn coming from the heated false twist setting zone is passed through a jet of cooling air prior to reaching the twisting means to thereby cool said yarn prior to untwisting.

* * * * *

PO-1050
(5/69)

UNITED STATES PATENT OFFICE
CERTIFICATE OF CORRECTION

Patent No. 3,956,878 Dated May 18, 1976

Inventor(s) Peter Schaefer; Geoffrey R. Scantlebury

It is certified that error appears in the above-identified patent and that said Letters Patent are hereby corrected as shown below:

[75] Cancel the name "Schaffer" and substitute therefore the name -- Schaefer --.

Column 2, line 44, cancel the word "of" and substitute therefore the word -- or --.

Column 5, line 46, cancel "8.,000" and substitute therefore -- 8,000 --.

Signed and Sealed this
Ninth Day of November 1976

[SEAL]

*Attest:*

RUTH C. MASON
*Attesting Officer*

C. MARSHALL DANN
*Commissioner of Patents and Trademarks*